US007053543B2

(12) United States Patent
Jüstel et al.

(10) Patent No.: US 7,053,543 B2
(45) Date of Patent: May 30, 2006

(54) PLASMA PICTURE SCREEN WITH BLUE PHOSPOR

(75) Inventors: Thomas Jüstel, Aachen (DE); Wolfgang Busselt, Roetgen (DE); Hans Nikol, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 558 days.

(21) Appl. No.: 09/795,613

(22) Filed: Feb. 28, 2001

(65) Prior Publication Data

US 2001/0033133 A1 Oct. 25, 2001

(30) Foreign Application Priority Data

Mar. 1, 2000 (DE) ..... 100 09 916

(51) Int. Cl.
*H01J 17/49* (2006.01)
*H01J 62/04* (2006.01)
*H01J 1/62* (2006.01)

(52) U.S. Cl. ..... 313/487; 313/486; 313/485; 313/582; 252/301.4 R; 252/301.4 F

(58) Field of Classification Search ..... 313/582, 313/586, 587, 485, 486, 487, 489; 252/301.4 P, 252/301.4 F, 301.4 R, 301.4 H
See application file for complete search history.

(56) References Cited

U.S. PATENT DOCUMENTS 5,747,100 A * 5/1998 Petersen ..... 427/64
6,187,225 B1 * 2/2001 Rao ..... 252/301.4 H

FOREIGN PATENT DOCUMENTS

JP 09263756 A * 10/1997
KR 9506429 B1 * 6/1995
WO WO 139239 A1 * 5/2001

OTHER PUBLICATIONS

Patent Abstracts of Japan, Yamakawa Masahiko: "Phosphor And Color Plasma Display Panel" Publication No. 09263756, Jul 10, 1997, Application No. 08075959, Mar. 29, 1996.

* cited by examiner

*Primary Examiner*—Nimeshkumar D. Patel
*Assistant Examiner*—Mariceli Santiago
(74) *Attorney, Agent, or Firm*—Aaron Walker

(57) ABSTRACT

A plasma picture screen provided with a luminescent layer which comprises a blue $Eu^{2+}$-activated phosphor and a UV-C light emitting phosphor. The mixing of an UV-C light emitting phosphor with an $Eu^{2+}$-activated phosphor or coating of an $Eu^{2+}$-activated phosphor with a UV-C light emitting phosphor or coating of a base layer of an $Eu^{2+}$-activated phosphor with a covering layer of a UV-C light emitting phosphor clearly reduces the photodegradation of the $Eu^{2+}$-activated phosphors in the VUV range.

8 Claims, 2 Drawing Sheets

PLASMA PICTURE SCREEN WITH BLUE PHOSPOR

BACKGROUND OF THE INVENTION

1. Field of the Invention

The invention relates to a plasma picture screen provided with a luminescent layer, which comprises a blue, $Eu^{2+}$-activated phosphor, as well as to a luminescent screen and a phosphor preparation.

2. Description of the Related Art

Plasma picture screens can display color pictures with high resolution, large screen diameter and have a compact construction. A plasma picture screen comprises a hermetically closed glass cell which is filled with a gas and which has electrodes arranged in a grid. The application of a voltage causes a gas discharge which generates light in the ultraviolet range (145 to 185 nm). This light is converted into visible light by phosphors and emitted through the front plate of the glass cell to the viewer.

Phosphors which are particularly efficient when excited by UV are used for plasma picture screens. Frequently used blue-emitting phosphors are, for example, $BaMgAl_{10}O_{17}$:Eu (BAM) and $(Ba,Sr,Ca)_5(PO_4)_3Cl$:Eu (SCAP) which are activated by europium in the bivalent state $Eu^{2+}$. $Eu^{2+}$-activated phosphors, however, show a strong decrease in the luminous efficacy upon irradiation with vacuum UV light (100 to 200 nm), whereas only little ageing is to be observed upon irradiation with long-wave UV light (200 to 400 nm).

The photodegradation of the $Eu^{2+}$-activated phosphors when excited by VUV light is caused by the oxidation of the activator $Eu^{2+}$ to $Eu^{3+}$. The presence of $Eu^{3+}$ in the phosphor particles reduces the luminous efficacy, because $Eu^{3+}$ ions trap the excitons and return to the base state without emitting radiation.

The use of phosphors with activators which are more photostable such as, for example, $Ce^{3+}$ or $Pb^{2+}$ could eliminate this problem. These phosphors, however, show a lesser color saturation and a substantially lower luminous efficacy when excited by VUV than $Eu^{2+}$-activated phosphors.

BRIEF SUMMARY OF THE INVENTION

The invention has for its object to provide a plasma picture screen provided with an improved blue-emitting phosphor.

This object is achieved by means of a plasma picture screen which is provided with a luminescent layer comprising an $Eu^{2+}$-activated phosphor and an UV-C light emitting phosphor.

The combination of an $Eu^{2+}$-activated phosphor with a UV-C light emitting phosphor prevents the photodegradation of $Eu^{2+}$-activated phosphors by VUV light, whose wavelength lies below 200 nm.

Preferably, the UV-C light emitting phosphor is chosen from the group comprising $LaPO_4$:Pr, $YPO_4$:Pr, $YBO_3$:Pr, $Y_2SiO_5$:Pr, $LuBO_3$:Pr, and $YPO_4$:Bi.

These UV phosphors prevent the photodegradation of $Eu^{2+}$-activated phosphors by VUV light in a particularly effective way.

It is furthermore preferred that the $Eu^{2+}$-activated phosphor is chosen from the group comprising $BaMgAl_{10}O_{17}$:Eu and $(Ba,Sr,Ca)_5(PO_4)_3Cl$:Eu.

These blue-emitting phosphors are particularly suitable for use in plasma picture screens because they show a high color saturation as well as an efficient conversion of UV light into blue light, and because they withstand the thermal loads during the manufacture of the plasma picture screens.

A preferred embodiment is characterized in that the luminescent layer comprises a mixture of particles of the $Eu^{2+}$-activated phosphor and particles of the UV-C light emitting phosphor.

It is preferred in this embodiment that the proportional quantity of the particles of the UV-C light emitting phosphor lies between 1 and 50% by weight.

This embodiment can be realized in a simple manner because the UV-C light emitting phosphor can be simply added to the suspension of the phosphor with which the luminescent layer is manufactured.

A further preferred embodiment is characterized in that the particles of the $Eu^{2+}$-activated phosphor are coated with a layer of the UV-C light emitting phosphor.

Another preferred embodiment is characterized in that the luminescent layer comprises a base layer which contains the $Eu^{2+}$-activated phosphor and a covering layer which contains the UV-C light emitting phosphor.

The invention further relates to a luminescent screen provided with a luminescent layer which contains an $Eu^{2+}$-activated phosphor and a UV-C light emitting phosphor.

Such a luminescent screen may be used in an appliance which also operates with a plasma emitting VUV light such as, for example, a xenon discharge lamp.

The invention also relates to a phosphor preparation which contains an $Eu^{2+}$-activated phosphor and a UV-C light emitting phosphor.

This phosphor preparation may be used as a luminescent material in an appliance which operates with a plasma emitting VUV light such as, for example, a xenon discharge lamp.

BRIEF DESCRIPTION OF THE DRAWINGS

The invention will now be explained in more detail below with reference to two Figures and three embodiments, where.

DETAILED DESCRIPTION OF THE INVENTION

Figure 1:
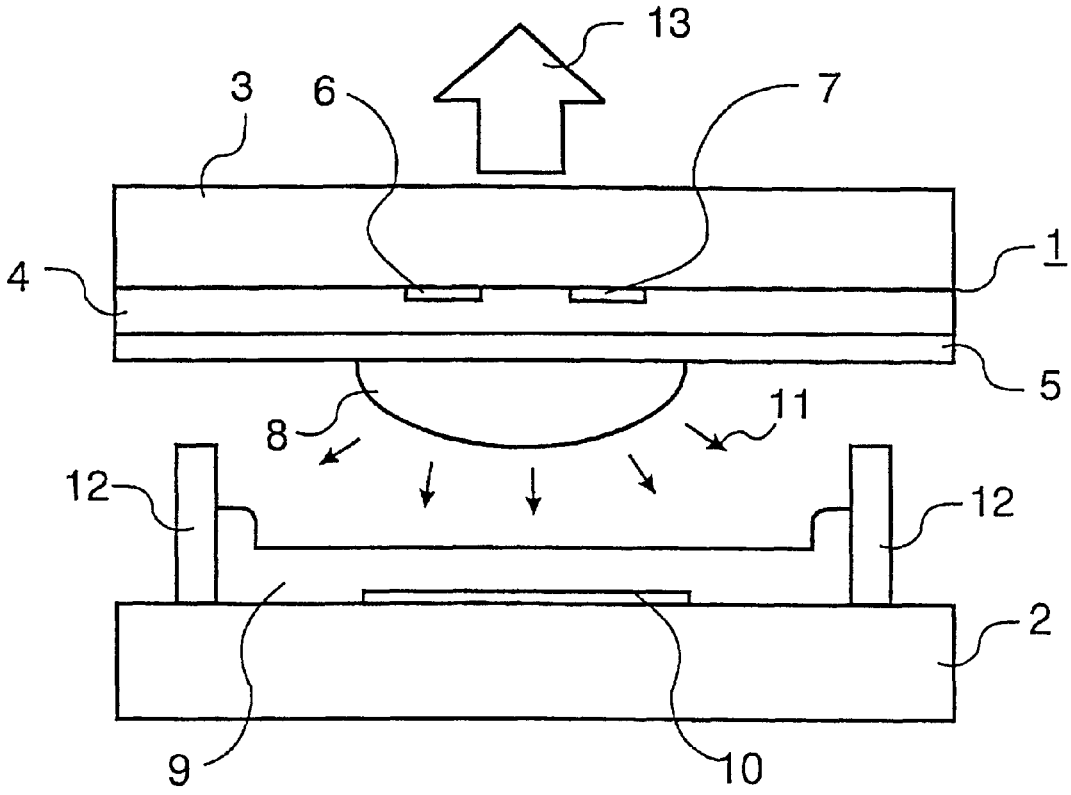
FIG. 1 shows the construction and operating principle of a single plasma cell in an AC plasma picture screen.

In FIG. 1 a plasma cell comprises an AC plasma picture screen with a planar parallel arrangement of a front plate 1 and a back plate 2. The front plate 1 comprises a glass plate 3 on which a dielectric layer 4 and thereon a protective layer 5 are provided. The protective layer 5 is preferably made of MgO and the dielectric layer is made, for example, of glass containing PbO. Parallel, strip-shaped discharge electrodes 6, 7 are provided on the glass plate 3 and covered by the dielectric layer 4. The discharge electrodes 6, 7 are made, for example, of a metal or ITO. The back plate 2 is made of glass, and parallel, strip-shaped address electrodes 10, for example made of Ag, are provided on the back plate 2 so as to run perpendicularly to the discharge electrodes 6, 7. These address electrodes 10 are covered with phosphor layers 9 in one of the three basic colors: red, green or blue. The individual phosphor layers 9 are separated by barriers 12, which are preferably made of a dielectric material.

A gas, preferably a rare gas mixture of, for example, He, Ne, Xe, or Kr, is present in the plasma cell, also between the discharge electrodes 6, 7, of which one is the cathode and the other is the anode each time. After ignition of the surface discharge, whereby charges can flow along a discharge path lying between the discharge electrodes 6, 7 in the plasma region 8, a plasma is formed in the plasma region 8 by which preferably radiation 11 in the UV range or in the VUV range is generated. This radiation 11 excites the phosphor layer 9 into phosphorescence, thus emitting visible light 13 in one of the three basic colors, which light issues to the exterior through the front plate 1 and thus forms a luminous pixel on the picture screen.

Blue phosphors used are, for example, $Eu^{2+}$-activated phosphors such as $BaMgAl_{10}O_{17}$:Eu or $(Ba,Sr,Ca)_5(PO_4)_3Cl$:Eu. The blue-emitting phosphor layer comprises besides the blue phosphor also a UV-C light emitting phosphor such as, for example, $LaPO_4$:Pr, $YPO_4$:Pr, $YBO_3$:Pr, $Y_2SiO_5$:Pr, $LuBO_3$:Pr, or $YPO_4$:Bi.

The activator $Eu^{2+}$ is directly excited when an $Eu^{2+}$-activated phosphor is irradiated with UV light whose wavelength is 200 nm or more. The electronically excited $Eu^{2+}$ cation returns to its ground state emitting a photon with a wavelength of 450 nm.

The excitation of the $Eu^{2+}$-activated phosphor with UV light whose wavelength lies below 200 nm leads to an excitation of the host lattice. This results in excitons (electron-hole pairs) being formed. A hole formed is trapped by an $Eu^{2+}$ cation, whereby an $Eu^{3+}$ cation is formed. The remaining electron may on the one hand be caught by an $Eu^{3+}$ cation, whereby an activated $Eu^{2+}$ cation is formed, which returns to the ground state again while emitting a photon with the wavelength of 450 nm. Alternatively, however, an electron may be caught by a defect, called anion void or also color center, in the crystal lattice of the phosphor. A problem in this case is that $Eu^{3+}$ cations remain in larger quantities, which interferes with the luminescence of the $Eu^{2+}$ cation.

These anion voids lie approximately 5 eV below the conduction band of the phosphor in the case of $Eu^{2+}$-activated BAM or SCAP. An electron present in such an anion void can be freed again through the supply of the corresponding amount of energy. The released electron can then be caught again either by an $Eu^{3+}$ cation or once more by an anion void. In the latter case, however, it can be released again through a fresh supply of energy.

This energy required for releasing an electron from an anion void corresponds to the energy range of UV-C radiation of 200 to 300 nm. A combination of the $Eu^{2+}$-activated phosphors with UV-C light emitting phosphors immediately supplies the required energy for releasing electrons again which were caught in anion voids. The electrons can as it were be recycled.

The blue phosphor may either comprise a mixture of particles of the $Eu^{2+}$-activated phosphor and the UV-C light emitting phosphor or an $Eu^{2+}$-activated phosphor with a coating of an UV-C light emitting phosphor, or a base layer of the $Eu^{2+}$-activated phosphor and a covering layer of an UV-C light emitting phosphor.

Manufacturing methods for such a luminescent layer which are suitable are both dry coating methods, for example electrostatic deposition or electrostatically supported dusting, and wet coating methods, for example silk-screen printing, dispenser methods in which a suspension is provided by means of a nozzle moving along the channels, or sedimentation from the liquid phase.

For the wet coating methods, the $Eu^{2+}$-activated phosphors must be dispersed in water, an organic solvent, possibly in combination with a dispersing agent, a surfactant, and an anti-foaming agent, or a binder preparation. Suitable for binder preparations for plasma picture screens are inorganic binders which can withstand an operating temperature of 250° C. without decomposition, brittling, or discoloration, or organic binders which can be subsequently removed by oxidation.

If the luminescent layer comprises a mixture of the $Eu^{2+}$-activated phosphor and the UV-C light emitting phosphor, a suspension is simply prepared with the two phosphors. The proportional quantity of UV-C light emitting phosphor lies preferably between 1 and 50% by weight in relation to the quantity of the $Eu^{2+}$-activated phosphor.

On the other hand, if the phosphor comprises an $Eu^{2+}$-activated phosphor which is coated with an UV-C light emitting phosphor, the coated phosphor is first manufactured. For this purpose, the $Eu^{2+}$-activated phosphor is suspended in distilled water, and subsequently particles of the UV-C light emitting phosphor are added whose particle sizes lie between 100 and 1000 nm. The pH value of the solution of the $Eu^{2+}$-activated phosphor is adjusted such that the $Eu^{2+}$-activated phosphor and the UV-C light emitting phosphor will have mutually opposed surface charges in the subsequent suspension. The suspension is stirred for a few more hours and then the coated phosphor is filtered off and dried. Then a suspension of the coated phosphor for coating of the back plate 2 is prepared as described above.

If the luminescent layer is to comprise a base layer of $Eu^{2+}$-activated phosphor and a covering layer of a UV-C light emitting phosphor, a suspension of the $Eu^{2+}$-activated phosphor is first provided on the back plate 2 and dried. Then a covering layer of a suspension of the UV-C light emitting phosphor is provided on this base layer and dried.

The red- and green-emitting phosphor layers are subsequently prepared in an analogous manner.

After the phosphor layers 9 have been provided, the back plate 2 is used together with further components such as, for example, a front plate 1 and a mixture of rare gases for the manufacture of a plasma picture screen.

In principle, such a luminescent layer may be utilized for all types of plasma picture screens such as, for example, AC plasma picture screens with or without matrix arrangement or DC plasma picture screens.

In addition, such a luminescent layer may be used in the luminescent screen of a xenon discharge lamp or in some other appliance which operates with a VUV light emitting plasma.

Figure 2:
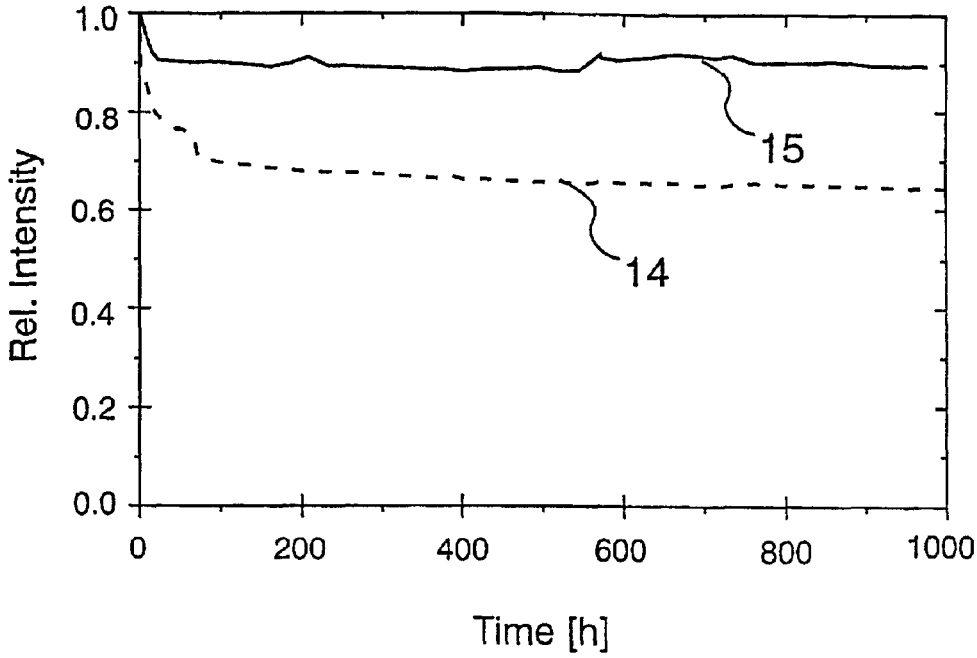
FIG. 2 shows the relative luminous intensities radiated by $BaMgAl_{10}O_{17}$:Eu and a phosphor mixture of $BaMgAl_{10}O_{17}$:Eu and 10% by weight of $LaPO_4$:Pr.

FIG. 2 shows the relative luminous intensity in the case of a xenon discharge for $BaMgAl_{10}O_{17}$:Eu and a phosphor mixture of $BaMgAl_{10}O_{17}$:Eu with 10% by weight of $LaPO_4$:Pr as a function of time. Graph 14 here shows the relative luminous intensity for a phosphor layer of $BaMgAl_{10}O_{17}$:Eu. Graph 15 shows the relative luminous intensity for a phosphor layer of $BaMgAl_{10}O_{17}$:Eu with 10% by weight of $LaPO_4$:Pr. The decrease in the luminous intensity in time is clearly less in the latter layer.

Embodiments of the invention are explained in more detail below, representing examples of how the invention may be implemented in practice.

Embodiment 1

First a suspension of 20 g $BaMgAl_{10}O_{17}$:Eu and 2 g $LaPO_4$:Pr was prepared, to which additives such as an organic binder and a dispersing agent were added. The suspension was provided on a back plate 2 by means of silk-screen printing and dried. This process step was carried out subsequently for the other two phosphor types with the emission colors green and red.

All additives remaining in the phosphor layers 9 were removed by a thermal treatment of the back plate 2 at 400 to 600° C. in an atmosphere containing oxygen. Such a back plate 2 was then used for manufacturing a plasma picture screen.

To determine the relative luminous intensity in dependence on time, part of the suspension was used for manufacturing a luminescent screen in a cylindrical lamp. The latter was subsequently filled with 200 mbar xenon gas and sealed. After Al strip electrodes had been applied, the lamp was operated by means of a standard circuit for dielectric barrier discharge lamps. The relative luminous intensity as a function of the operating time is shown in FIG. 2. Graph 14 here corresponds to a luminescent layer with $BaMgAl_{10}O_{17}$:Eu and graph 15 to a luminescent layer with $BaMgAl_{10}O_{17}$:Eu and 10% by weight of $LaPO_4$:Pr.

Embodiment 2

90 g $BaMgAl_{10}O_{17}$:Eu ($d_{50}$=5 μm) was suspended in 50 ml distilled water, and the pH value of the solution was adjusted to pH=7.5. Then 10 g $LaPO_4$:Pr ($d_{50}$=0.6 μm) was added and the suspension was stirred for 2 hours. The BAM phosphor coated with $LaPO_4$:Pr was filtered off and dried at 80° C.

A suspension of the coated phosphor was subsequently prepared, to which additives such as an organic binder and a dispersing agent were added. The suspension was provided on a back plate 2 by means of silk-screen printing and dried. This process step was carried out subsequently for the other two phosphor types with the emission colors green and red.

All additives remaining in the phosphor layers 9 were removed by a thermal treatment of the back plate 2 at 200 to 600° C. in an atmosphere containing oxygen. Such a back plate 2 was then used for manufacturing a plasma picture screen.

Embodiment 3

A suspension of $BaMgAl_{10}O_{17}$:Eu was first manufactured, to which additives such as an organic binder and a dispersing agent were added. The suspension was provided on a back plate 2 by means of silk-screen printing and dried.

Subsequently, a suspension of $YBO_4$:Bi was manufactured, to which additives such as an organic binder and a dispersing agent were added. This suspension was provided by silk-screen printing on those portions of the back plate 2 on which previously $BaMgAl_{10}O_{17}$:Eu had been provided, and was dried. Thus a covering layer of $YBO_4$:Bi was present on the base layer of $BaMgAl_{10}O_{17}$:Eu.

Furthermore, suspensions of phosphor types with the emission colors green and red were subsequently manufactured, to which respective additives such as an organic binder and a dispersing agent were added. These suspensions were provided on the back plate 2 by means of silk-screen printing and dried.

All additives remaining in the luminescent layers 9 were removed by a thermal treatment of the back plate 2 at 400 to 600° C. in an atmosphere containing oxygen. Such a back plate 2 was then used for manufacturing a plasma picture screen.

What is claimed is:

1. A plasma picture screen provided with a luminescent layer, which has a heterogeneous mixture of an $Eu^{2+}$-activated phosphor and a UV-C light emitting phosphor.

2. A plasma picture screen as claimed in claim 1, characterized in that the UV-C phosphor is chosen from the group consisting of: $LaPO_4$:Pr, $YPO_4$:Pr, $YBO_3$:Pr, $Y_2SiO_5$:Pr, $LuBO_3$:Pr, and $YPO_4$:Bi.

3. A plasma picture screen as claimed in claim 1, characterized in that the $Eu^{2+}$-activated phosphor is chosen from the group consisting of: $BaMgAl_{10}O_{17}$:Eu and $(Ba,Sr,Ca)_5(PO_4)_3Cl$:Eu.

4. A plasma picture as claimed in claim 1, wherein the luminescent layer comprises a mixture of particles of the $Eu^{2+}$-activated phosphor and particles of the UV-C light emitting phosphor.

5. A plasma picture screen as claimed in claim 4, characterized in that the proportional quantity of the particles of the UV-C light emitting phosphor lies between 1 and 50% by weight.

6. A plasma picture screen as claimed in claim 1, characterized in that the particles of the $Eu^{2+}$-activated phosphor are coated with a layer of the UV-C light emitting phosphor.

7. A plasma picture screen as claimed in claim 1, characterized in that the luminescent layer comprises a base layer which contains the $Eu^{2+}$-activated phosphor and a covering layer which contains the UV-C light emitting phosphor.

8. A luminescent screen provided with a luminescent layer which contains a heterogeneous mixture of an $Eu^{2+}$-activated phosphor and a UV-C light emitting phosphor.

* * * * *